United States Patent [19]

Kadi

[11] Patent Number: 4,530,213

[45] Date of Patent: Jul. 23, 1985

[54] ECONOMICAL AND THERMALLY EFFICIENT CRYOPUMP PANEL AND PANEL ARRAY

[75] Inventor: Frank J. Kadi, New Tripoli, Pa.

[73] Assignee: Air Products and Chemicals, Inc., Allentown, Pa.

[21] Appl. No.: 508,408

[22] Filed: Jun. 28, 1983

[51] Int. Cl.[3] ..... B01D 8/00

[52] U.S. Cl. ..... 62/55.5; 55/269; 62/268; 417/901

[58] Field of Search ..... 62/55.5, 100, 268; 417/901; 55/269

[56] References Cited

U.S. PATENT DOCUMENTS

| | | | |
|---|---|---|---|
| 3,620,029 | 11/1971 | Longsworth | 62/6 |
| 4,121,430 | 10/1978 | Bächler et al. | 62/55.5 |
| 4,150,549 | 4/1979 | Longsworth | 62/55.5 |
| 4,212,170 | 7/1980 | Winkler | 62/55.5 |
| 4,219,588 | 8/1980 | Longsworth | 427/160 |
| 4,267,707 | 5/1981 | Hemmerich | 62/55.5 |
| 4,277,951 | 7/1981 | Longsworth | 62/55.5 |
| 4,295,338 | 10/1981 | Welch | 62/55.5 |

*Primary Examiner*—Ronald C. Capossela

*Attorney, Agent, or Firm*—James C. Simmons; E. Eugene Innis

[57] ABSTRACT

A cryopump of vertically tiered individual generally conical shaped sections with linearly increasing base diameters arranged smaller to larger base diameter as the distance increases from the coldest end of elongated refrigeration source. Individual cryopanels are a surface of revolution with tapered bayonet joint interlocking portions to permit ease of assembly while maintaining good thermal contact between sections.

9 Claims, 3 Drawing Figures

ECONOMICAL AND THERMALLY EFFICIENT CRYOPUMP PANEL AND PANEL ARRAY

TECHNICAL FIELD

The present invention pertains to capturing gas molecules on extremely cold surfaces from enclosed volumes of low pressure to create ultra-high vacuums. In particular the invention relates to a unique cryopanel and cryopanel array adapted to maintain high pumping speeds for hydrogen while simultaneously pumping large quantities of argon and air.

BACKGROUND OF THE PRIOR ART

The prior art of cryopumping (cryogenic pumping) is adequately set out in the specification of U.S. Pat. No. 4,150,549, the specification of which is incorporated herein by reference. The '549 patent discloses one type of panel which is ideally suited for the coldest end of an elongated refrigerator to pump, among other things, hydrogen, argon and air. U.S. Pat. No. 4,219,588 discloses a method for improving the cryopumping apparatus of the '549 patent while U.S. Pat. No. 4,277,951 discloses a low profile cryopumping apparatus. U.S. Pat. No. 4,121,430 is representative of a number of cryopumps with panels of varying configuration on the cold end of the cryogenic refrigerator.

U.S. Pat. No. 4,295,338 discloses and claims a cryopanel array of the type which is cumbersome and difficult to fabricate and not overly thermally efficient, of which the present invention is a vast improvement.

BRIEF SUMMARY OF THE INVENTION

The present invention relates to a cryopump and in particular to a cryopanel designed for the second or coldest stage of a two-stage cryogenic refrigerator of the displacer expander type wherein the panel geometry is a vertically tiered conical array with linearly increasing base diameters from the cold end of the refrigerator toward the warm stage of the refrigerator with tapered bayonet joint interlocking cryopanel sections to permit ease of assembly while maintaining good thermal contact between the sections. An individual panel geometry according to the present invention is able to maintain extremely high hydrogen pumping speeds while simultaneously pumping large quantities of argon and air. A cryopanel array according to the present invention features ease of assembly, lower cost, and thermal efficiency heretofore unknown with prior art devices of apparently similar construction.

DETAILED DESCRIPTION OF THE PREFERRED EMBODIMENT

In the Semiconductor Industry during recent years cryopumps have become accepted as means for creating a vacuum in much of the process equipment currently used in the fabrication of large-scale integrated circuits.

Acceptance of the cryopump is due largely to its high pumping speed and the elimination of the potential for oil contamination which is prevalent with diffusion pumps heretofore used to create the vacuum environment. It has been a concern of the industry that the present crypumps require far too much regeneration because the cryopump is basically a "capture" pump wherein accumulation of cryo-deposited and adsorbed gases ultimately leads to a need to rid the pump of the gases thus captured. Prior art pumps which require frequent regeneration have a severe limitation since the production rate of integrated circuit chips can not easily be maintained while the cryopumps are being regenerated.

Current commercially available crypumps which apparently have high capacities for most of the commonly encountered process gases share the common problem that the time interval between regeneration often decreases when two or more gases are being pumped simultaneously. This is frequently encountered in sputtering equipment where both argon and hydrogen are pumped simultaneously and regeneration is prompted by a noticeable drop-off in the hydrogen pumping speed. This decrease in speed can result from either contamination of the hydrogen adsorbent by abundant argon molecules or the plugging of the hydrogen passages by the cryo-deposited argon. Plugging creates a drop-off of hydrogen molecular conductance and subsequent decrease in speed.

Figure 1:
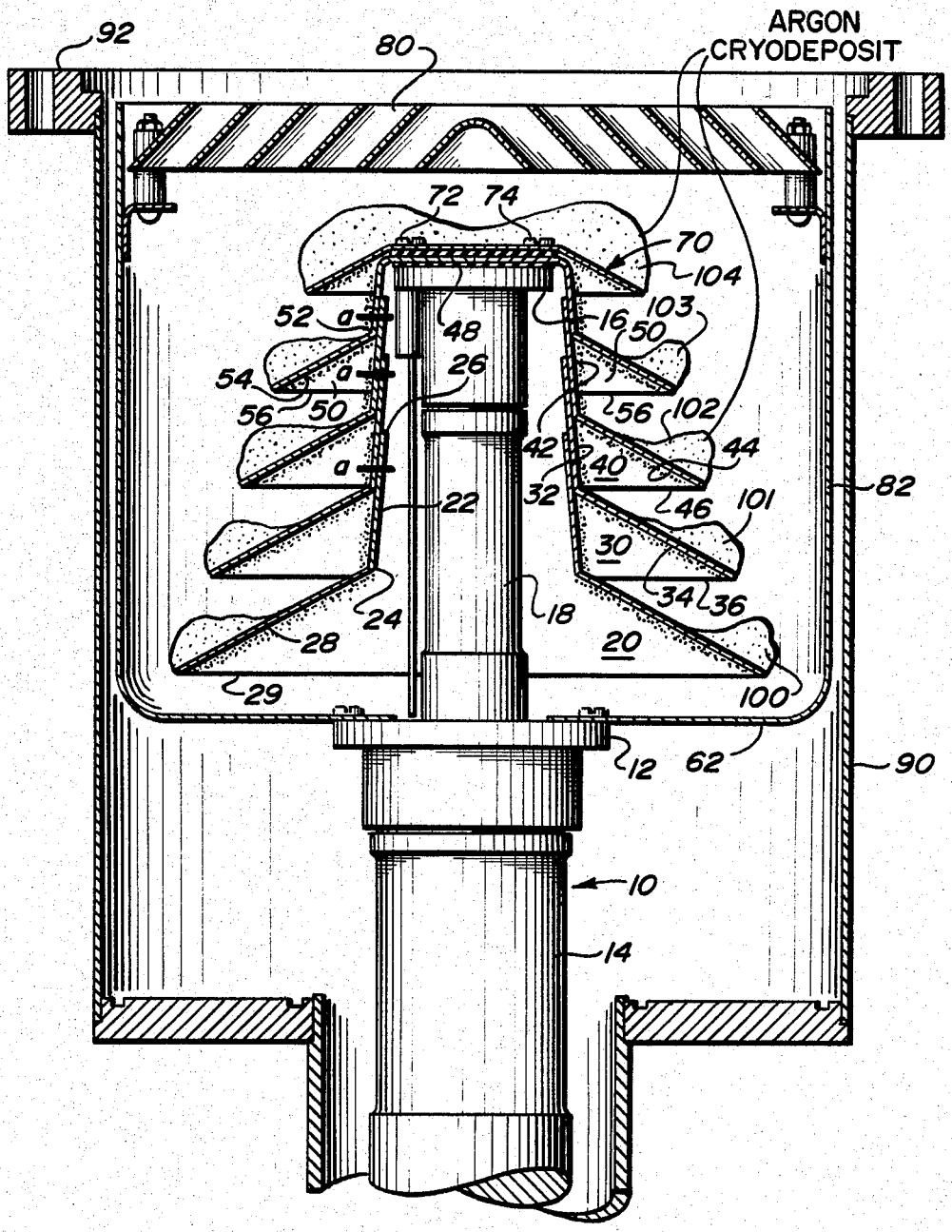
FIG. 1 is a fragmentary front elevational view partially in section of a device according to the present invention.
Figure 2:
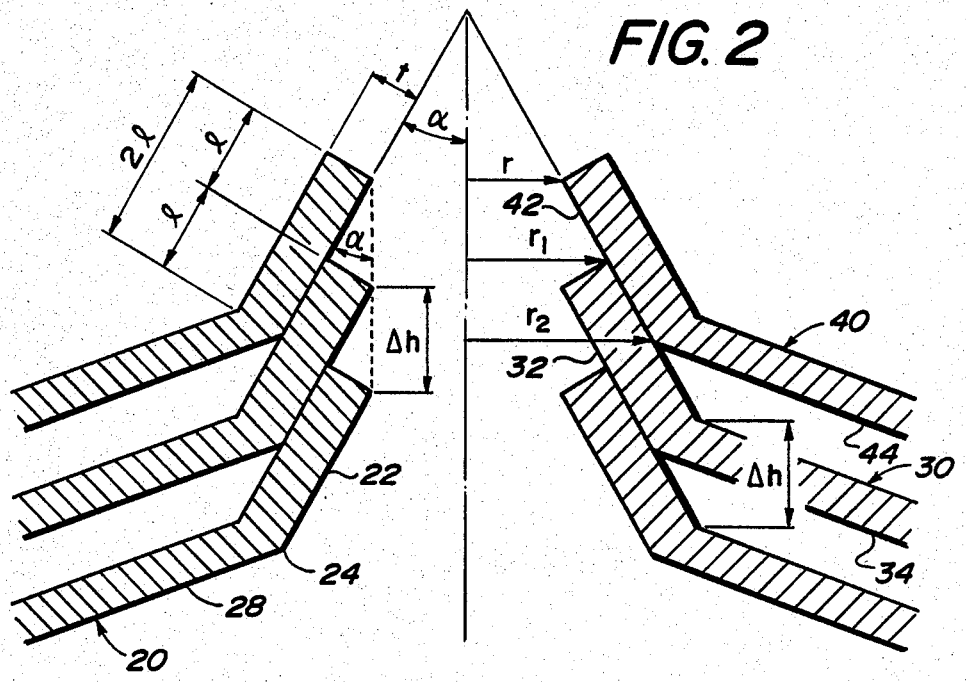
FIG. 2 is an enlarged and exaggerated diagram of the interlocking mechanism for the cryopanel array of FIG. 1.

Referring to FIG. 1, there is shown a cryogenic refrigerator 10 of the displacer expander type suitable for use in cryopumping applications. Such a refrigerator is disclosed and claimed in U.S. Pat. No. 3,620,029 and is sold under various model designations by Air Products and Chemicals, Inc. under the Trademark DISPLEX. The refrigerator operates on a modified Solvay cycle producing refrigeration in the order of 77° K. (Kelvin) at the base of heat station 12 of the first stage 14 and refrigeration of 10°-20° K. at heat station 16 of second stage 18. The cryopanel array of the present invention is built from independent conical surfaces of revolution which are interlocked, bayonet fashion, one with the other. Each surface of revolution, for example, cryopanel 20 of the array of FIG. 1, includes a first portion 22 in the form of a tapered cylindrical adaptor or bayonet section which begins on the first end 26 and tapers outwardly toward a second end 24 which as a continuous surface 28 in the form of a cone with a relatively flat angle between wall 28 and base 29. The next cryopanel 30 is identical to cryopanel 20, but is of smaller outside diameter for the conical portion. The next panel in the array 40 has the same overall configuration, but is also of smaller diameter at the base of the cone than panel 30. The uppermost panel 50 is again of smaller diameter at the base of the cone than panel 40 and also includes a closed top 48 which can be placed on heat station 16 so that good thermal contact can be maintained between heat station 16 and cryopanel 50 and in turn the increasingly larger diameter cryopanels can be supported by panel 50. While panel 50 is fabricated with a closed top it could be identical to the other panels (e.g., 20, 30, 40) and its adaptor or bayonet section 52 disposed around the circumference of heat station 16. Referring to FIG. 2, the method of putting the panels together is based upon the overlapped bayonet joint which is shown greatly exaggerated in FIG. 2. For a given panel thickness, t, and tapered bayonet angle, $\alpha$, the overlap, l, of the adjacent panel is given by the formula:

$$l = t/\tan\alpha$$

The spacing between panels, h, is given by the formula:

$$\Delta h = t/\sin\alpha$$

The contact surface area $A_c$ in the bayonet contact region between panels is determined by the formula:

$$A_c = \pi(2r + 2t\cos\alpha + l\sin\alpha)\sqrt{\Delta h^2 + l^2 \sin 2\alpha}$$

For a cryopanel wherein the radius r is to be 0.975 in., $\alpha$, equals 2.2° and the geometric parameters are:

l equals 0.65 inches (16.5 mm) h=0.65 inches (16.5 mm) $A_c$ equals 4.14 sq. in. (26.7 $cm^2$). The modular construction technique permits application of charcoal or other adsorbent to the interior conical surface (e.g. interior wall 28 of cryopanel 20) of each cryopanel in the array prior to assembly. This technique also makes it possible to include a layer of charcoal in the outer exposed portions of the first or tapered cylindrical portion 22 of panel 20 and the other tapered portions (34, 44, 54 of panels 30, 40, 50) which are exposed for the succeeding tapered cylindrical portions (32, 42, 52 of panels 30, 40, 50) of the cryopanel array. The modular construction permits ease of application of charcoal and positive interlocking of sections without the need for an excessive number of fasteners or solder. In point of fact, it would be possible to spot weld the sections together with a minimum number of welds, thus enhancing rather than decreasing heat transfer capability of the cryopanels. Utilization of a tapered bayonet interface with a small taper angle, $\alpha$, and generous overlap dimension, l, generates high interface contact stresses and large contact surface areas, both of these boundary conditions reducing the effects of thermal contact resistance which must be minimized in order to reduce the temperature difference between any two points on the cryopanel array. Further reduction in cryopanel temperature difference may be achieved by putting a thin coating of a high thermal conductivity medium such as high thermal conductivity epoxy on the contact area between panels. A large degree of adjacent bayonet joint overlap is used to insure the continuity and wall thickness of the composite tubular core which is necessary to convey heat from the outer reaches of each panel to the heat sink provided by the refrigerator heat station.

Positive locking of adjacent sections is most economically insured by spot welding at two or three points within the overlapping position of the tapered bayonet joint at a position indicated as line "a" of FIG. 1. While spot welding is preferred, riveting, punch pricking, screwing or bolting along the same joint can also be used. Alternatively, the entire assembly may be locked together by the use of slender axial bolts which are passed through the inside of the entire structure and used to hold the entire array in a state of compression. The use of tapered bayonet joints while illustrated as a means of assembling the cryopanel for a commercial cryopump, can be used to assemble any cryopanel array which is axially symmetric geometry. The joint and panel geometry described lends itself to economical mass production techniques such as metal spinning and hydroforming.

The cryopanel array illustrated in FIG. 1 consists of a vertical tier of conical sections with the linearly increasing base diameters from the heat station 16 toward the heat station 12 of the refrigerator 10. The conical silhouette of this array provides a large frontal surface area when viewed from the cryopump inlet louver 80 while allowing adequate protection for the charcoal from premature argon contamination. The device of FIG. 1 includes a top or cover panel 70 which is fastened to the heat station 16 by suitable fasteners such as bolts 72 and 74. Sandwiched between top panel 70 and top of cryopanel 70 and also between the bottom of croypanel 70 and top flat surface of the 2nd stage heat station 16 are indium gaskets 48 which are used to enhance the transmission of heat. The number of panels in a given array depends upon the application so that there is enough charcoal surface area to ensure high hydrogen capacity while providing a large enough gap between adjacent surfaces to prevent plugging of the gaps. According to tests, five conical sections provide a good balance between these requirements.

As is well known in the art, a louver 80 by means of a housing or second-stage panel 82 is thermally connected to the warmer or second stage heat station 12 of the refrigerator 10. The entire cryopump can be enclosed in a housing 90 with a suitable flange 92 for mounting to a vacuum chamber as is well known in the art. A temperature sensor is often used to monitor the refrigerator's second stage temperature.

Figure 3:
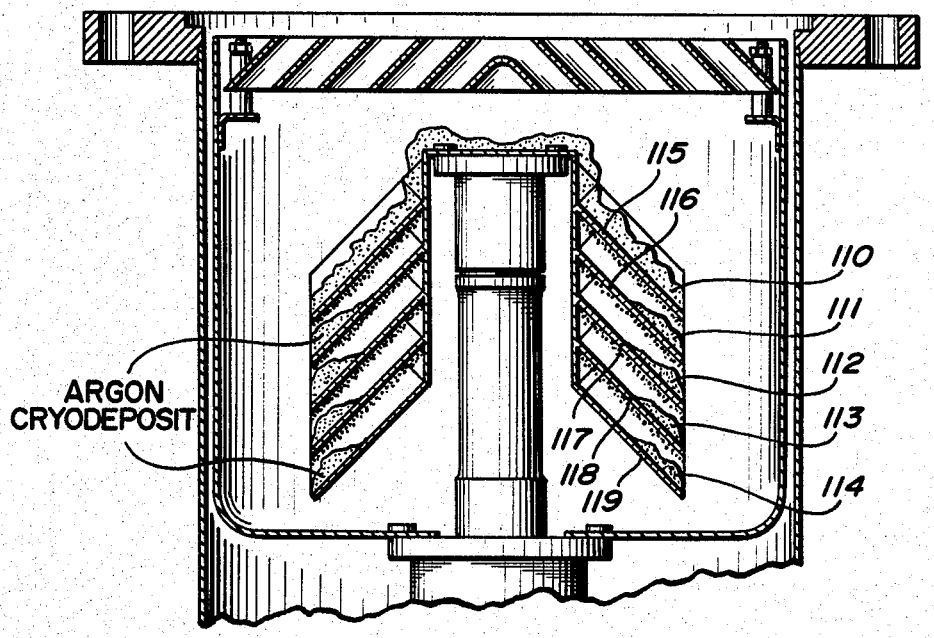
FIG. 3 PRIOR ART
FIG. 3 is a fragmentary front elevational view of a prior art apparatus illustrating argon cryodeposition on the cryopanel surfaces.

FIG. 1 shows the deposition characteristics for argon on the various cryopanels. The deposition or deposit being shown as 100, 101, 102, 103, and 104 on panels 20, 30, 40, 50 and 70, respectively. Testing of a cryopanel array according to FIG. 1 in a situation intended to simulate its primary use in an argon sputtering application has shown the geometry of the FIG. 1 device to have an extremely high tolerance for large quantities of cryo-deposited argon before any indications of a drop-off in hydrogen pumping speed was noted. At least 735,000 torr-liters of argon were deposited before the hydrogen speed fell to 85% of its initial value. It is believed that the excellent performance of this cryopanel geometry is attributable in large part to the conical silhouette wherein the base diameters of the individual cones increases linearly from the cold end of the refrigerator toward the warm end. The frontal surface area provided by the nonoverlapping outer region of each succeeding larger conical section provides a site for the accumulation of large quantities of argon. The deposition of argon in these preferred zones delays the build up of argon in the overlapping sections of adjacent tiers which are in much closer proximity to the charcoal surface normally reserved for the adsorption of hydrogen. An illustration of the probable argon deposition profile for the device of U.S. Pat. No. 4,295,338 is shown in FIG. 3 wherein the argon deposit is identified as 110, 111, 112, 113, and 114 on panels 115, 116, 117, 118 and 119, respectively. In FIG. 1 and FIG. 3 argon deposition profiles it will be noted that the deposition profile of the device of FIG. 1 delays both the contamination of the charcoal and the reduction of molecular conductance required to insure sustained high hydrogen pumping speeds. The prior art device of FIG. 3 shows contamination of exposed adsorbent or premature reduction of hydrogen conductance by partial or total argon plugging. Vertical alignment of the adjacent cryopanel surfaces, such as shown in device of FIG. 3, create a condition in which the bulk of cryo-deposited argon builds up at the entrance of the flow passages leading to the hydrogen adsorbent surfaces which are on the bottom of the sloping sides of the panels 115, 116, 117, 118, and 119. This partial obstruction reduces the hydrogen molecular conductance and thereby reduces the hydrogen pumping speed significantly.

A device according to the present invention used with a cryogenic refrigerator cooling the cryopanel array to 20° K. can be used in the Semiconductor Industry, specifically for argon sputtering applications used in the fabrication of large scale integrated circuits. The primary gas species to be cryopumped are argon and hydrogen and occasionally air. The argon and air are frozen out on the bare second-stage cryopanel surfaces on the top of the individual cryopanels (20, 30, 40, 50, 70) while the hydrogen is adsorbed in charcoal granules which are epoxied to the undersurfaces of the conical-section of cryopanels 20, 30, 40, 50 and 70. Cryopanels used in these applications must have a high capacity for both argon and hydrogen so that regeneration is required as infrequently as possible. The requirement for high argon and hydrogen capacity, together with sustained high hydrogen pumping speeds, typically requires a panel with both a large bare surface area and a large charcoal-coated surface. In addition, the charcoal surfaces must be fairly well protected from contamination by cryo deposits of argon or air in order to maintain a high hydrogen capacity. The present invention overcomes all of the prior art problems and provides the required operating characteristics in order to be effective in removing argon, air and hydrogen from the vacuum chamber.

Having thus described my invention, what is desired to be secured by Letters Patent of the United States is set forth in the appended claims.

I claim:

1. In a cryopump of the type having an elongated refrigeration source adapted to mount and cool a cryopanel, the improvement comprising:

a plurality of cryopanels of each being a surface of revolution having a tapered bayonet interface portion being of generally cylindrical shape, the walls of the cylinder tapering slightly from a first end of said interface portion to a second end of said interface portion and a major pumping surface portion being a continuation of said interface portion and being in the shape of a truncated cone with a relatively flat angle between the base and the wall of said cone;

said cryopanels fabricated with differing diameters for the base of said pumping surface whereby the plurality of cryopanels are fixed by suitable means to said refrigeration source in a vertical array with the smaller diameter panel first and the larger diameter panel last installed beginning at the coolest end of said refrigeration source.

2. A cryopump according to claim 1 where in the means to fix said cryopanel array to said refrigeration source includes the smallest diameter of said panels having a closed bottom which can be placed over the end of said refrigeration source and fixed thereto.

3. A cryopump according to claim 2 including generally open bottom, closed top truncated conical cryopanel of smaller diameter than the smallest diameter cryopanel in said array fixed to the top of said refrigeration source the side of said cone in parallel with the sides of the smallest cone of said array.

4. A cryopump according to claim 1 wherein the cryopanels are arranged with the major conical pumping surfaces parallel to one another.

5. A cryopump according to claim 1 wherein said cryopanels have an adsorbent on the inner surface of said major pumping surface.

6. A cryopump according to claim 1 wherein said cryopanels include an adsorbent on the outer surface of said first or tapered interface portion.

7. A cryopump according to claim 1 wherein said cryopanels nest with high interference contact stresses and large contact surface areas.

8. A cryopump according to claim 1 wherein said cryopanels are fixed in a nested relation by spot welding or mechanically fastening adjacent panels around the tapered bayonet interface portion.

9. A cryopanel being a surface of revolution having a tapered bayonet interface portion being of generally cylindrical shape, the walls of the cylinder tapering slightly from a first end of said interface portion to a second end of said interface portion and a major pumping surface portion being a continuation of said interface portion and being in the shape of a truncated cone with a relatively flat angle between the base and the wall of said cone.

* * * * *